US009284113B2

(12) United States Patent
Corbeil

(10) Patent No.: US 9,284,113 B2
(45) Date of Patent: Mar. 15, 2016

(54) FLUID HANDLING AND CONTAINMENT SYSTEM, APPARATUS AND METHOD

(71) Applicant: Jason Corbeil, Bentley (CA)

(72) Inventor: Jason Corbeil, Bentley (CA)

( * ) Notice: Subject to any disclaimer, the term of this patent is extended or adjusted under 35 U.S.C. 154(b) by 246 days.

(21) Appl. No.: 13/847,402

(22) Filed: Mar. 19, 2013

(65) Prior Publication Data

US 2013/0240521 A1 Sep. 19, 2013

Related U.S. Application Data

(60) Provisional application No. 61/612,967, filed on Mar. 19, 2012.

(30) Foreign Application Priority Data

Mar. 19, 2012 (CA) ..... 2771477

(51) Int. Cl.

| | |
|---|---|
| ***B65D 88/08*** | (2006.01) |
| ***B65D 88/52*** | (2006.01) |
| ***B65D 88/54*** | (2006.01) |
| ***B65D 88/74*** | (2006.01) |
| ***B65D 90/20*** | (2006.01) |
| ***E04H 7/04*** | (2006.01) |

(52) U.S. Cl.

CPC ..... *B65D 88/08* (2013.01); *B65D 88/526* (2013.01); *B65D 88/54* (2013.01); *B65D 88/748* (2013.01); *B65D 90/205* (2013.01); *E04H 7/04* (2013.01); *Y10T 137/8593* (2015.04)

(58) Field of Classification Search

CPC ..... B65D 90/02; B65D 90/08; B21D 51/16; B21D 51/18

USPC ..... 137/225–267, 561 R, 571–592; 220/4.12, 4.16, 4.33, 200, 202, 565, 220/567.2, 601, 661, 677, 682

See application file for complete search history.

(56) References Cited

U.S. PATENT DOCUMENTS

| | | | | | |
|---|---|---|---|---|---|
| 1,195,958 | A | * | 8/1916 | Ash | 137/592 |
| 2,402,253 | A | * | 6/1946 | MacLeod | 220/681 |
| 4,112,639 | A | * | 9/1978 | Zimmermann | 52/174 |
| 4,318,549 | A | | 3/1982 | Pletcher | |
| 4,355,652 | A | * | 10/1982 | Perkins | 137/15.04 |
| 4,454,694 | A | | 6/1984 | Davanture | |

(Continued)

FOREIGN PATENT DOCUMENTS

| | | | | |
|---|---|---|---|---|
| KR | 20120028702 | * | 10/2012 | 220/592.24 |
| WO | WO 2010/009061 | | 1/2010 | |
| WO | WO 2012/006685 | | 1/2012 | |

*Primary Examiner* — Craig Schneider
*Assistant Examiner* — Daniel P Donegan
(74) *Attorney, Agent, or Firm* — Sander R. Gelsing

(57) ABSTRACT

A fluid containment system comprises a plurality of curved panels having a front face a rear face, a top end, a bottom end and two side ends, wherein the plurality of curved panels are positioned serially adjacent one another in a generally upright or vertical manner so as to comprise a generally circular arrangement, with each of the plurality of curved panels further comprising at least one fastening member on its front face and wherein the fastening member is suitable to generally abut to a similar fastening member of an adjacent curved panel. Once fastened, the plurality of curved panels may be lined with a liner and used for fluid storage. In another aspect a fluid handling and containment apparatus comprises a tank suitable to hold a volume of fluid, the tank having a main compartment with a plurality of outlets exiting from the main compartment.

12 Claims, 22 Drawing Sheets

(56) References Cited

U.S. PATENT DOCUMENTS

| | | | | |
|---|---|---|---|---|
| 5,704,509 | A * | 1/1998 | Rosenkrantz | 220/216 |
| 5,778,922 | A * | 7/1998 | Schoultz | 137/208 |
| 6,119,885 | A * | 9/2000 | Witter | 220/567.2 |
| 6,406,619 | B1 * | 6/2002 | Donald et al. | 210/151 |
| 6,915,815 | B1 * | 7/2005 | Ness | 137/259 |
| 7,117,896 | B2 * | 10/2006 | Eberling et al. | 137/899 |
| 7,815,222 | B2 * | 10/2010 | Markham | 280/837 |
| 8,104,501 | B1 * | 1/2012 | Ness | 137/259 |
| 8,534,480 | B1 * | 9/2013 | Hanna | 220/4.17 |
| 8,801,041 | B2 * | 8/2014 | Barrett et al. | 280/837 |
| 2009/0212550 | A1 * | 8/2009 | Albers | 280/837 |
| 2010/0032031 | A1 * | 2/2010 | Neal | 137/565.01 |
| 2010/0147860 | A1 * | 6/2010 | McKenzie | 220/626 |
| 2011/0006068 | A1 * | 1/2011 | Kaupp | 220/562 |
| 2011/0194893 | A1 | 8/2011 | Wiebe | |
| 2011/0211818 | A1 | 9/2011 | Grady | |
| 2011/0265405 | A1 * | 11/2011 | Ksenych et al. | 52/264 |
| 2012/0211490 | A1 * | 8/2012 | Su | 220/216 |
| 2013/0098910 | A1 * | 4/2013 | Simpson | 220/9.4 |
| 2013/0180996 | A1 * | 7/2013 | Lee et al. | 220/592.24 |

* cited by examiner

PRIOR-ART

*PRIOR-ART*

*PRIOR-ART*

*PRIOR-ART*

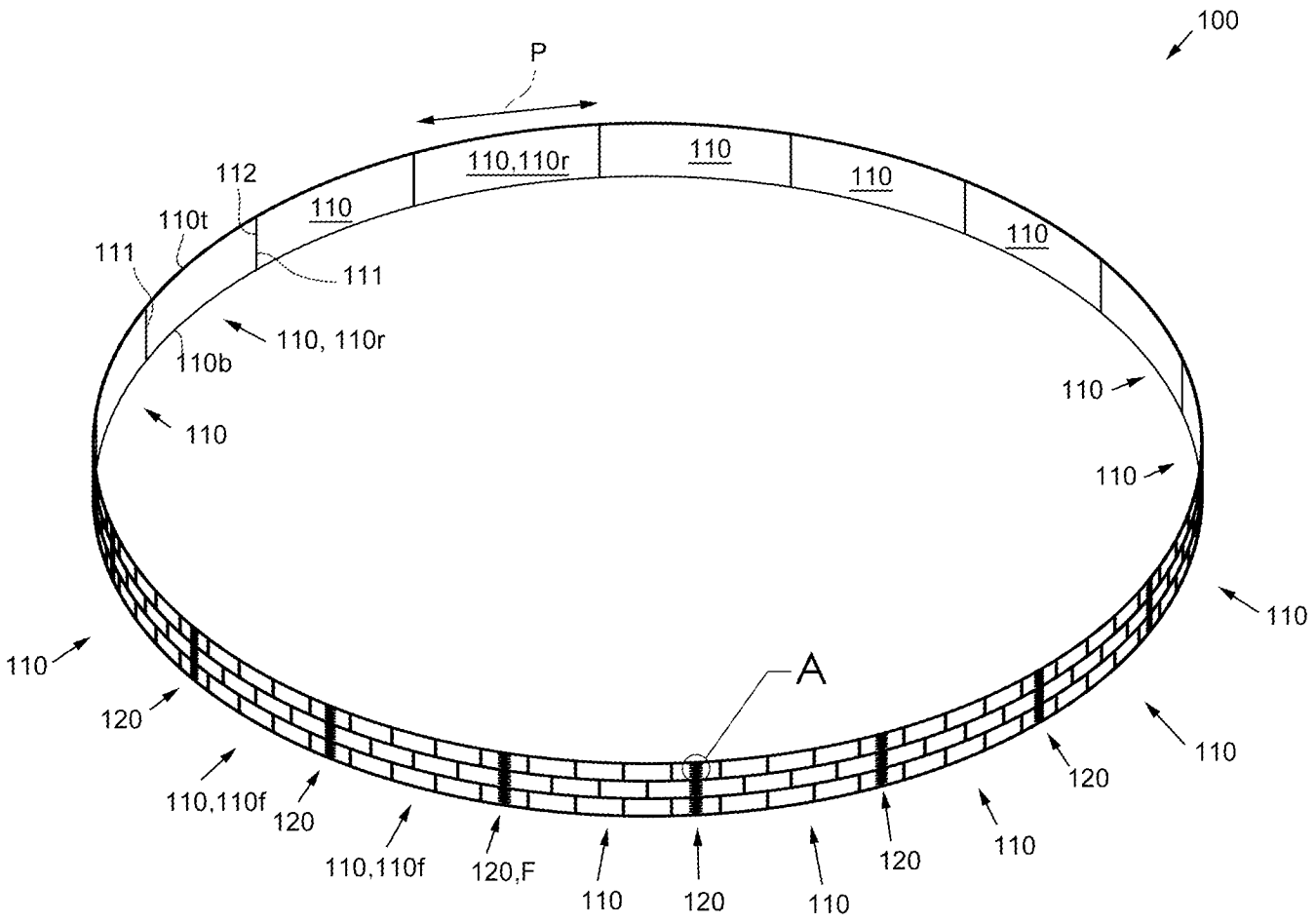
100
110
110
110

F
P
120
122
121
110, 110r
110,110f 120
121
110

C
120
110

120
122
110

D
110
120

FLUID HANDLING AND CONTAINMENT SYSTEM, APPARATUS AND METHOD

CROSS REFERENCE TO RELATED APPLICATION

This application is a regular application of U.S. Provisional Patent Application Ser. No. 61/612,967 filed Mar. 19, 2012 and entitled, "FLUID HANDLING AND CONTAINMENT SYSTEM, APPARATUS AND METHOD", the entirety of which is incorporated herein by reference.

FIELD OF THE INVENTION

The present invention relates generally to fluid handling systems and apparatus and, more particularly, to fluid handling systems and apparatus for use in the oilfield industry.

BACKGROUND OF THE INVENTION

Currently in the oil in gas industry a large emphasis has been put on the development of unconventional and "tight" reservoirs. This includes shale gas and oil, low permeability rock and coal bed methane. For the development of these reservoirs large hydraulic fracturing operations (also called fracing, fraccing or fracking) have been undertaken in conjunction with long horizontally drilled wellbores. The process of fracturing commonly is completed using large quantities of fracturing fluid, typically ranging from hundreds to tens of thousand of cubic meters of produced and fresh water.

The handling and logistics of dealing with these large amounts of fracturing fluids has led to the development of specialized equipment and processes. The most common approach initially was to haul in large 400 barrel (400 bbl) tank farms as shown in FIG. 1*a*; each tank typically having a volume of approximately 63 $m^3$. Such tank farms have ranged from ten to upwards of a hundred 400 bbl-sized tanks to facilitate required volumes of fracturing fluid.

Major disadvantages of this type of set up include large spatial foot print required, dependency on 400 bbl tank availability, large mobilization requirements, high mobilization/demobilization costs, high rental costs, tank cleaning costs, labour intensive hosing/manifold system required to tie all the 400 bbl tanks together, high water heating cost and high heat loss due to high surface-area-to-volume ratio of multiple 400 bbl tanks, and high rig matting requirements. A further disadvantage of such hosing/manifold system is that such system is subject to freezing during winter operations.

Other systems have been developed in an attempt to remove some of the disadvantages of the multiple 400 bbl tanks approach. One such system is to store large quantities of fracturing fluid in earthen lined or unlined pits and then transferring the fluid to a tank farm having a much smaller number of 400 bbl tanks, than the traditional set up. In this set up or system, the smaller number of 400 bbl tanks act as "buffer tank" so that fluid can be withdrawn at an equivalent rate to that required for the hydraulic fracturing operations. This method has benefits over the larger tank farms including smaller foot print, less heat loss. However, it requires large amounts of dirt work for the earthen pits and companies must abide by various environmental guide lines. This system also has some of the disadvantages as associated with larger tank farm set ups, including still requiring elaborate filling and suction manifold systems, as well as a need for high rate transfer pumping and piping system.

In recent years another method of fluid handling is the use of an above ground containment system (instead of earthen pits) along with the same smaller "buffer tank" system as used with the earthen pit system. This avoids the disadvantage associated with dirt work associated with the earthen pits. Such above ground containment system come in a variety of designs. Initially the primary design was a large corrugated sheet metal ring put up in sections of normally 4 ft×8 ft. These rings are then lined with a poly liner and used for fluid storage as shown in FIGS. 1*b* and 1*c*. These rings are, for the most part, an off shoot from secondary containment systems built by the Westeel Division of Vicwest Corporation headquartered in Winnipeg, Manitoba, Canada. Although very economical to purchase, such corrugated sheet metal rings proved to be very labour intensive to assemble, requiring multiple fasteners (usually nuts and bolts) which are passed through the overlapping corrugated sheet metal sections (from inside to outside; or vice-versa) and then are fastened. Such fastening (from inside to outside; or vice versa) also usually requires at least two labourers or workmen to complete the job (because it is difficult or impossible for a single person to reach around individual 4'×8' sections to fasten), with one positioned inside the ring's interior and a second positioned outside the ring, both labourers or workmen then having to coordinate their fastening effort. Disassembly of such corrugated steel metal rings provides similar disadvantages.

To overcome the labour intensive assembly and disassembly of the currogated sheet metal containment rings, Poseidon Concepts Corp. of Calgary, Alberta, Canada has developed a containment ring system comprised of large panels (12 foot× 24 foot) which is much quicker to set up due to their large panels (12'×24' vs 4'×8') and the use of a bolt-free connection system which utilizes a series of linking plates on the container's exterior (outside) surface only, as shown in FIG. 1*d*. However, these large panels are transported in a flat or horizontal arrangement (such as to avoid highway restrictions on load height). Moreover, large assembly equipment, such as picker trucks and track hoes are required to move and manipulate these large and heavy panels (such as between horizontal storage/transportation arrangement and the generally upright/vertical operational arrangement. This then also requires the use of qualified and certified equipment operators, all of which adds to the costs.

What is needed is a fluid handling and containment system which does not have the above-mentioned disadvantages.

SUMMARY OF THE INVENTION

The present invention is directed to overcoming the prior art deficiencies, including in the labour intensive assembly and disassembly of the fluid containment rings. The present invention is also directed to overcoming the prior art deficiencies in using multiple 400 bbl tanks to store and handle fluid during fracturing operations.

In one aspect the invention provides a fluid containment system comprising a plurality of curved panels having a front face a rear face, a top end, a bottom end and two side ends, wherein the plurality of curved panels are positioned serially adjacent one another in a generally upright or vertical manner so as to comprise a generally circular arrangement, with each of the plurality of curved panels further comprising at least one fastening member on its front face and wherein the fastening member is suitable to generally abut to a similar fastening member of an adjacent curved panel. Once fastened, the plurality of curved panels may be lined with a liner and used for fluid storage.

In a second aspect, the invention provides a fluid handling and containment apparatus comprising a tank suitable to hold a volume of fluid, the tank having a main compartment with a plurality of outlets exiting from the main compartment. These first and second aspects may be combined to contain and handle fluid in a system aspect.

In a method aspect, fluid may be directed from the fluid containment system of the first aspect, to the fluid handling and containment apparatus and then to a wellhead for use during fracturing operations.

BRIEF DESCRIPTION OF THE DRAWINGS

Referring to the drawings, several aspects of the present invention are illustrated by way of example, and not by way of limitation, in detail in the figures, wherein:

FIG. 2 is a perspective view of one embodiment of a fluid handling and containment system and apparatus;

DETAILED DESCRIPTION OF THE PREFERRED EMBODIMENTS

Figure 1A:
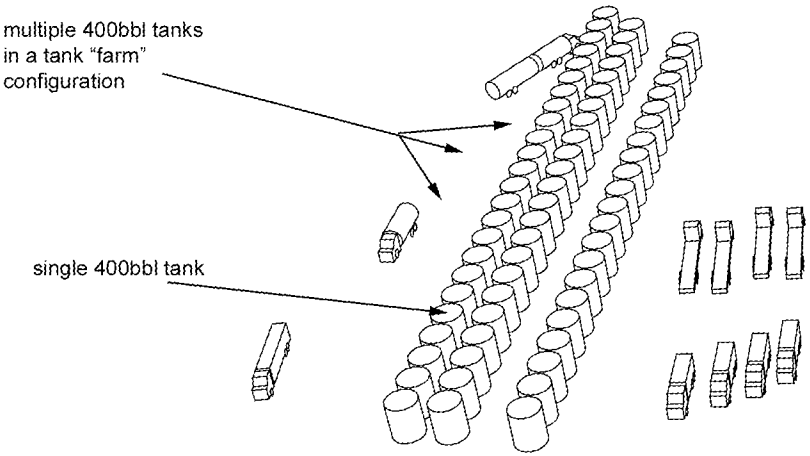
FIGS. 1*a*-1*d* are perspective views of various prior art fluid containment and handling systems, with FIG. 1*c* also showing an enlarged sectional view of overlapping corrugated sheets taken along line C-C in FIG. 1*c;*

The following description is of a preferred embodiment by way of example only and without limitation to the combination of features necessary for carrying the invention into effect. Reference is to be had to the Figures in which identical reference numbers identify similar components. The drawing figures are not necessarily to scale and certain features are shown in schematic or diagrammatic form in the interest of clarity and conciseness.

Referring to the FIGS. 2-6*c*, 10 and 11, various embodiments of a fluid handling and containment system and apparatus 100 are illustrated. These embodiments 100 comprise a plurality of curved panels 110 having a front (outside) face 110*f*, a rear (inside) face 110*r*, a top end 110*t*, a bottom end 110*b* and two side (connecting) ends 111, 112.

Figure 1B:
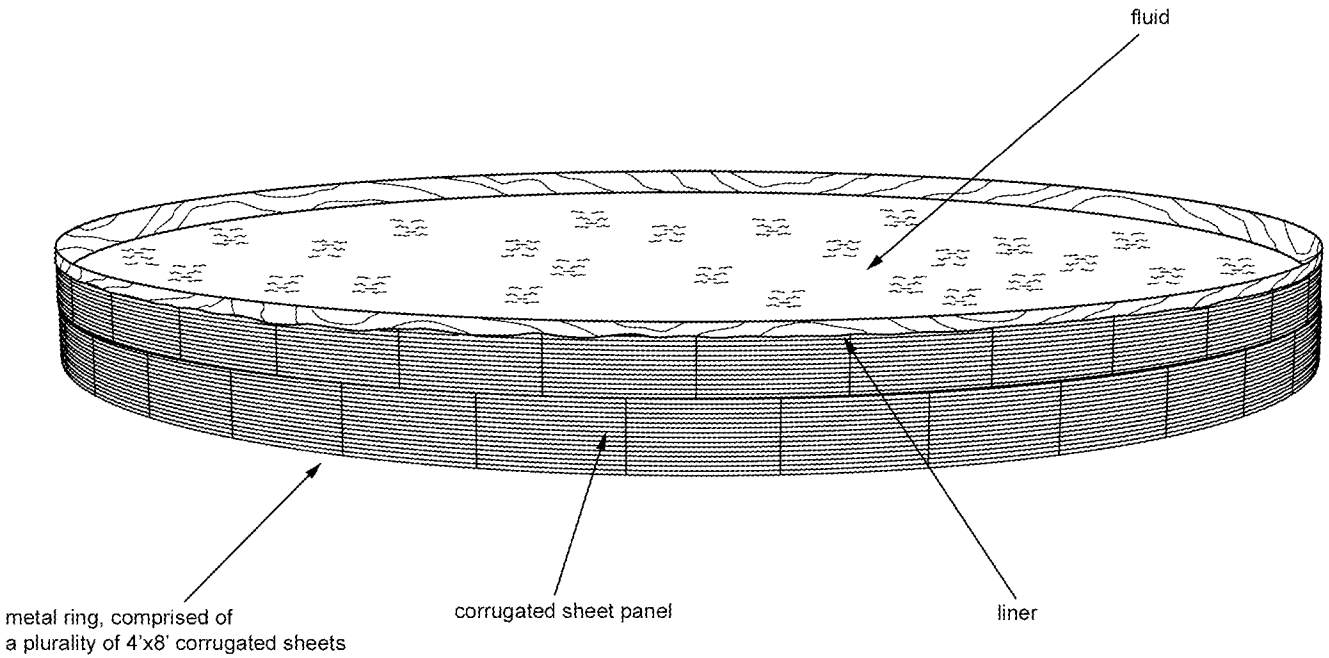
Figure 1C:
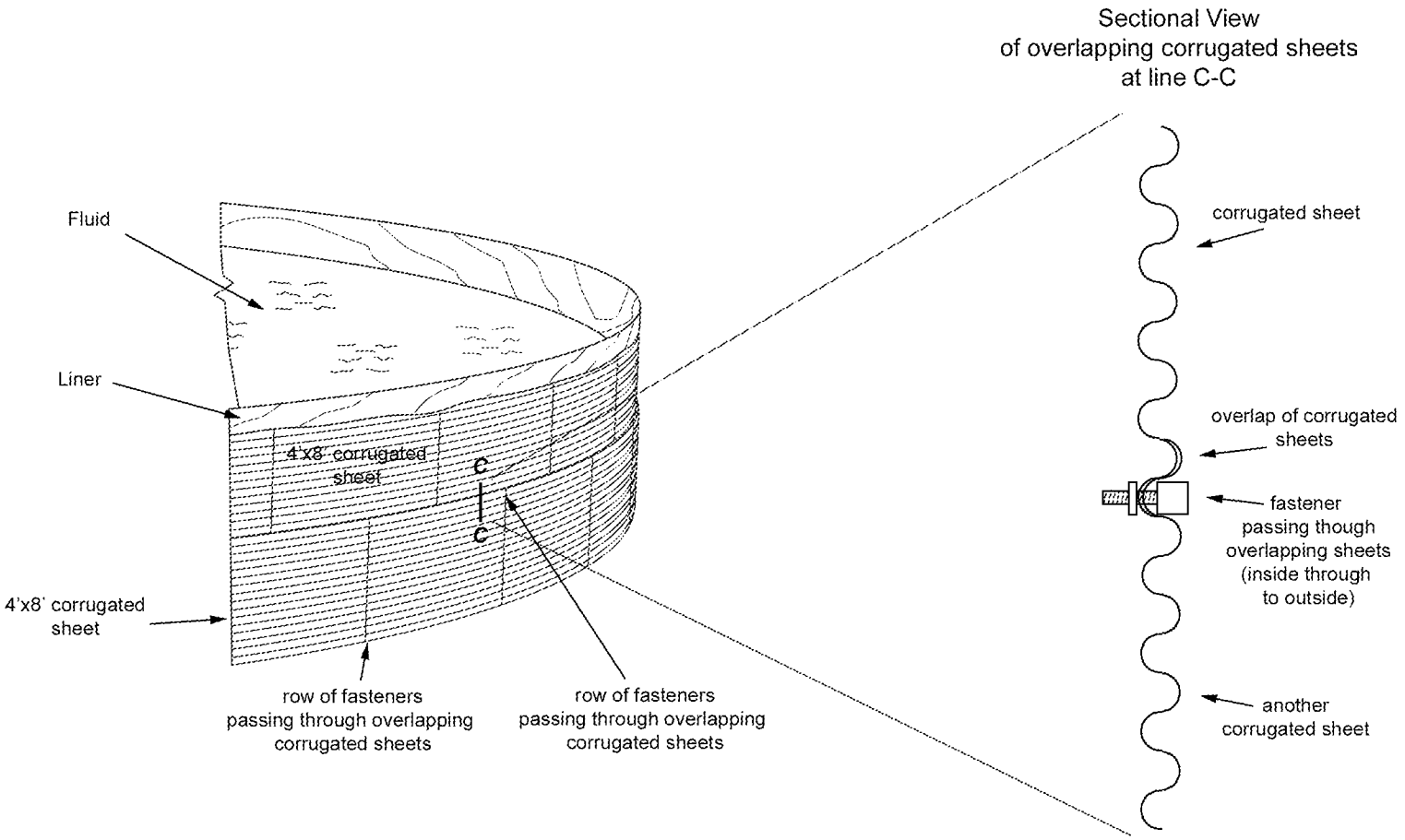
Figure 1D:
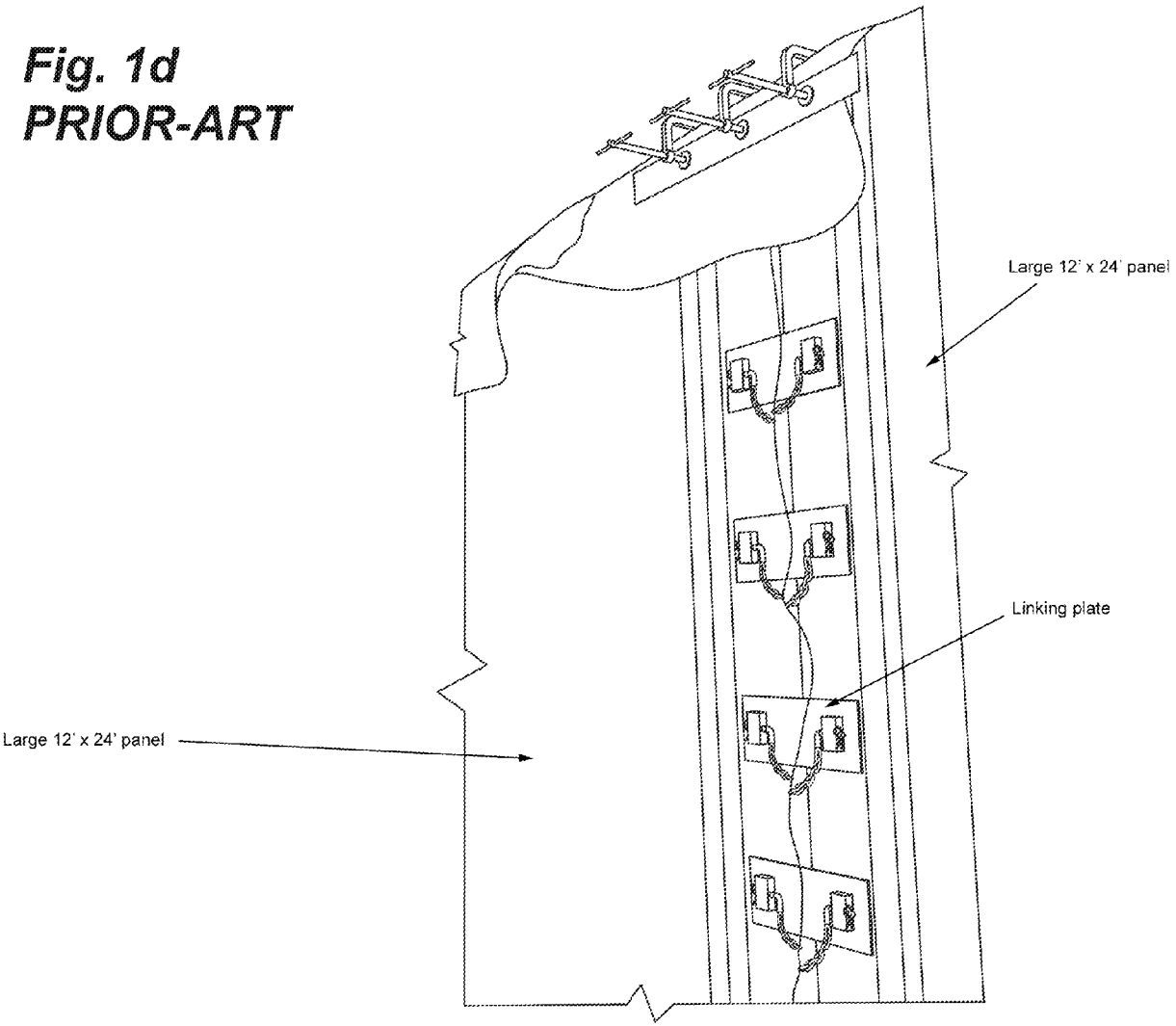
Figure 4A:
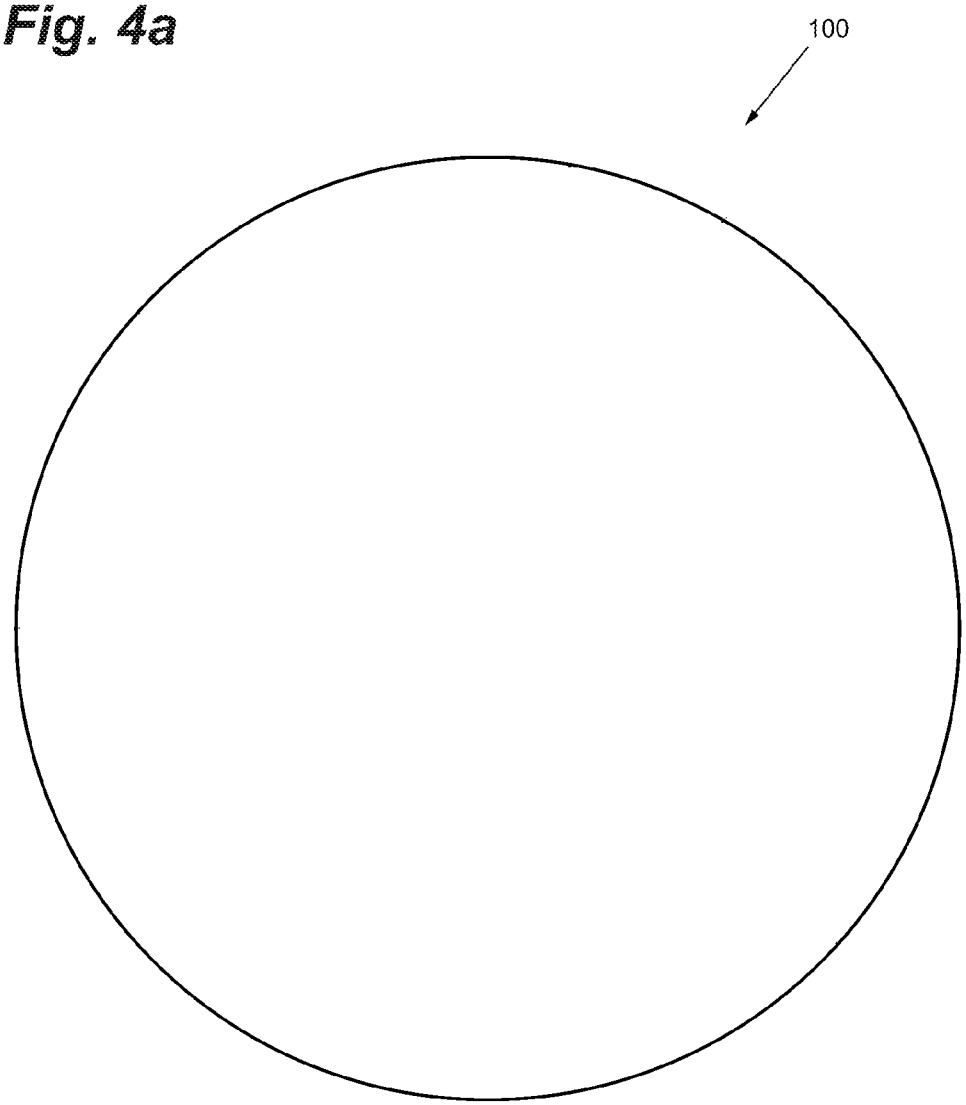
FIGS. 4*a*-5*g* are various views of another embodiment of a fluid handling and containment system and apparatus, similar to the embodiment of FIGS. 2-3.
Figure 4B:
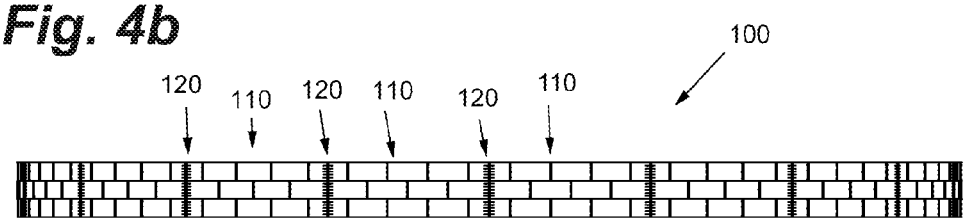
Figure 6A:
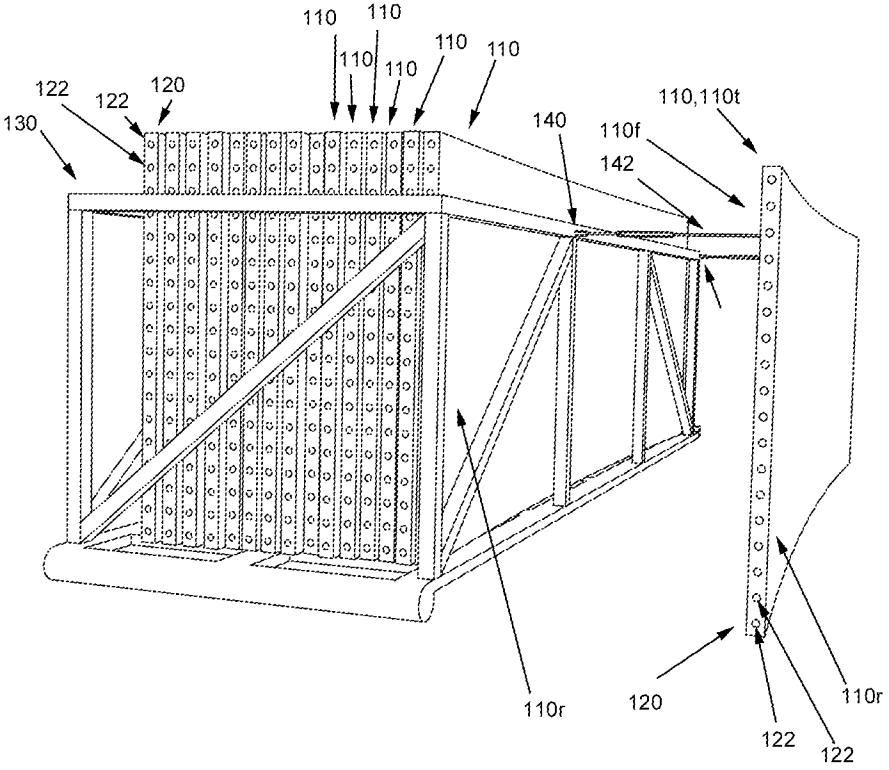
FIGS. 6*a*-6*c* are various perspective views of yet another embodiment a fluid handling and containment system and apparatus, illustrating storage of the system and apparatus as well as set-up of the system and apparatus.
Figure 6B:
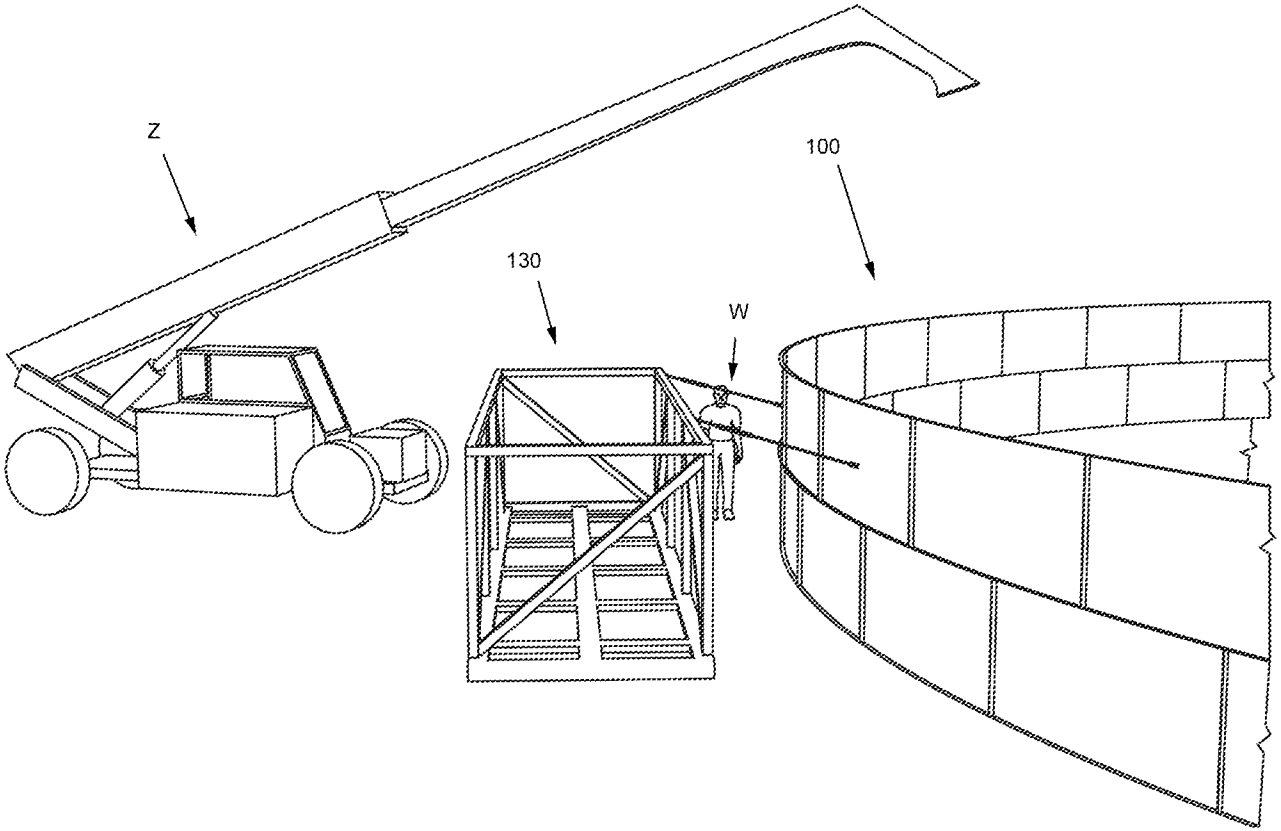

During operation, the panels 110 are positioned serially adjacent one another in a generally upright or vertical manner, on their bottom ends 110*b*, so as to comprise a generally circular or ring shape (as can be seen more clearly in FIGS. 2, 4*a* and 6*b*). When arranged in ring format, and with the individual panels 110 fastened to each other, the system and apparatus 100 is then suitable to be lined with a liner (such as a poly liner) and used for fluid storage, in a similar fashion as the conventional corrugated sheet metal rings are (as shown in FIGS. 1*b* and 1*c*). Preferably, the panels 110 are sized and dimensioned to allow the system and apparatus 100 to hold at least 3000 $m^3$ of fluid. More preferably the panels 110 are made of steel. Even more preferably, the panels 110 are 8 feet tall and 24 feet long.

Each of the curved panels 110 comprises at least one fastening member 120, on its front face 110*f* preferably at one of its side ends 111 or 112. Fastening member 120 is preferably a fastening flange 120*a* suitable to mate with, or generally abut to, a similar fastening member 120, 120*b* of an adjacent panel 110 (see FIG. 3). In another embodiment, fastening member 120 is a generally square tubular member (see FIG. 10).

Figure 5A:
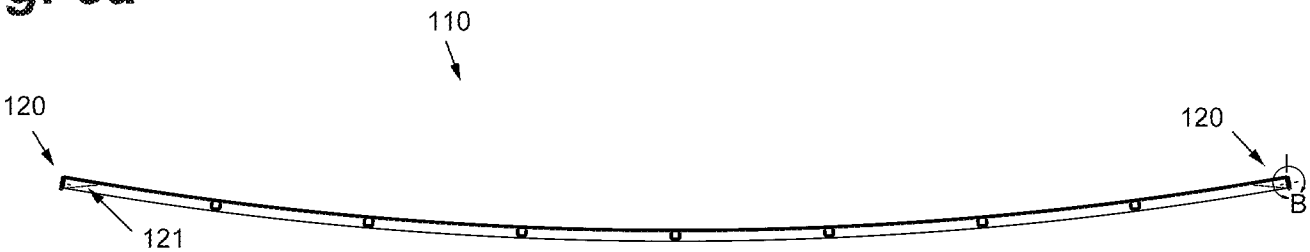
Figure 5B:
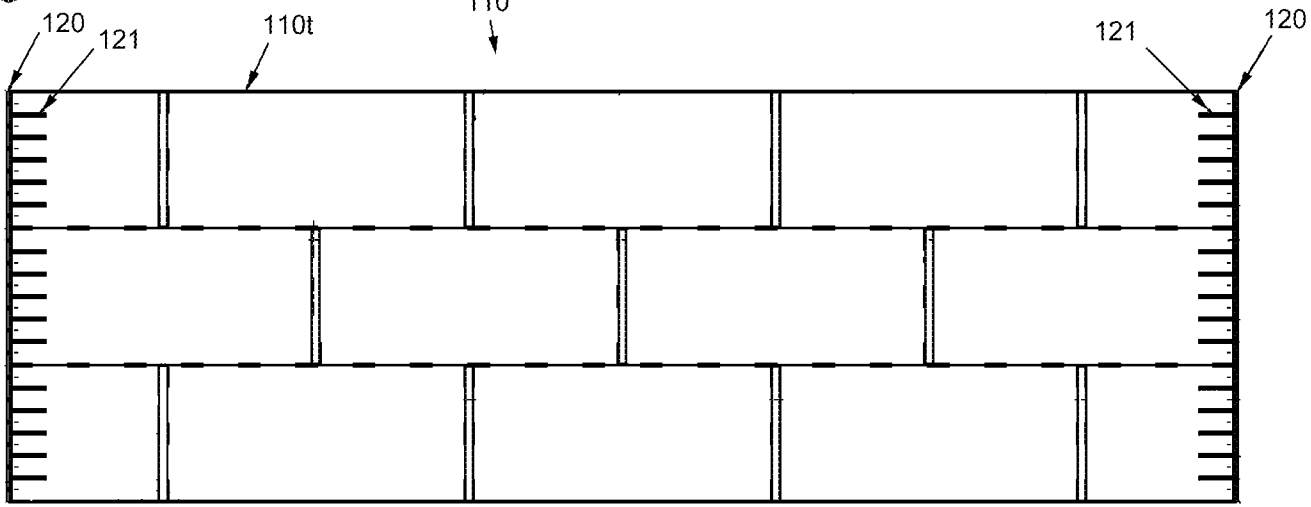
Figures 5C, 5D, 5E, 5F, 5G:
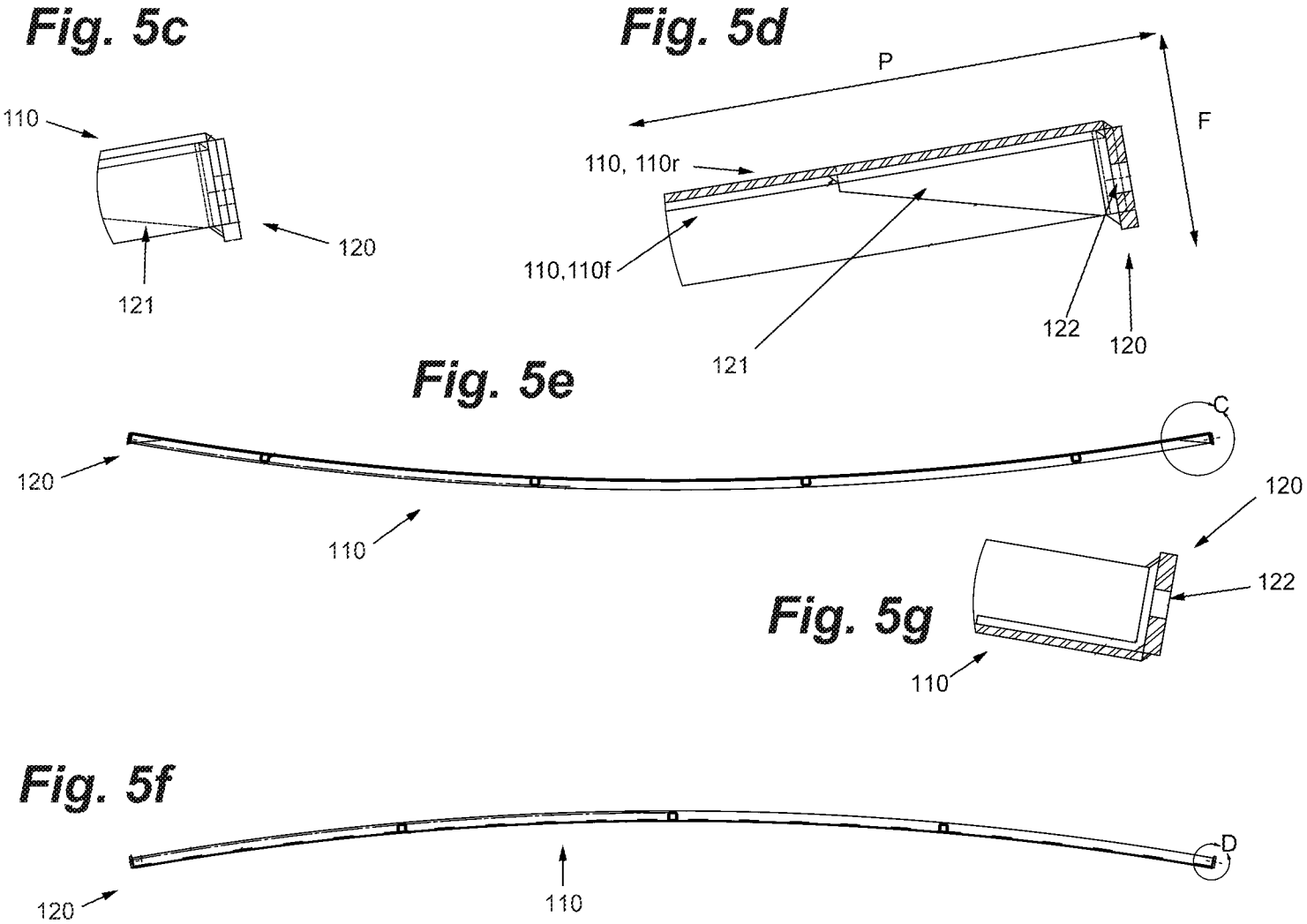

Preferably, the orientation or longitudinal plane F of the fastening flange 120 is substantially perpendicular to the longitudinal plane P of the panel 110 (see, for example, FIG. 5*d*; e.g. the longitudinal plane F is oriented substantially vertical vs the panel's longitudinal plane P being oriented substantially horizontal). However, other orientations of the fastening flange 120 relative to the panel 110 will work as long as fastening flanges 120*a*, 120*b* on adjacent panels suitably mate to allow fastening of one panel 110 to its adjacent panel 110. More preferably, a fastening flange 120 is provided at each of side ends 111, 112 for each panel 110 in the fluid handling and containment system and apparatus 100.

In a preferred embodiment, each of the fastening members 120 is provided with at least one fastener opening or passage 122 of sufficient size and dimensions to allow passage of a fastener therethrough. Further, in such preferred embodiment, the fastener openings 122 are positioned so as to align with the fastener openings 122 of an adjacent fastening flange 120 when adjacent panels 110 are aligned into the generally circular arrangement as shown in FIGS. 2, 4*a*, 6*b* and 10. Advantageously, adjacently positioned panels 110 may be easily fastened together using fasteners 124, preferably such as nuts 124*n* and bolts 124*b*, which are passed through the fastener opening 112 (see FIG. 3). More advantageously, the fastening operations of adjacent panels 110 to each other can be conducted from outside the ring of panels 110, without the need for a (second) workman placed within the circumference of the ring of panels 110, since fasteners 124 now pass through fastening members 120 that are on the front face 110*f* of the panels 110 and there is no longer a need for fasteners to pass through overlapping panel 110 sections as is the case in the corrugated steel rings (FIGS. 1B and 1C).

Figure 3:
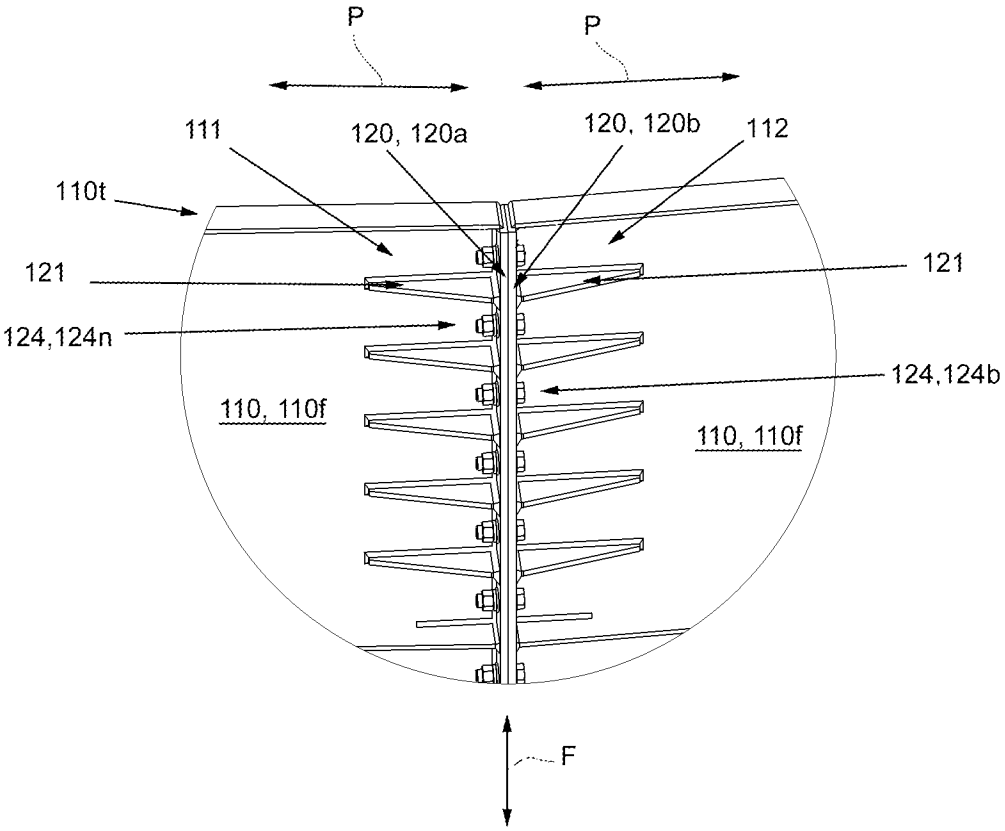
FIG. 3 is an enlargement of area A of FIG. 2.

Preferably, gussets 121 are provided to further secure fastening members 120 to the front face 110*f* of the panels 110 (see FIG. 3).

Figure 11:
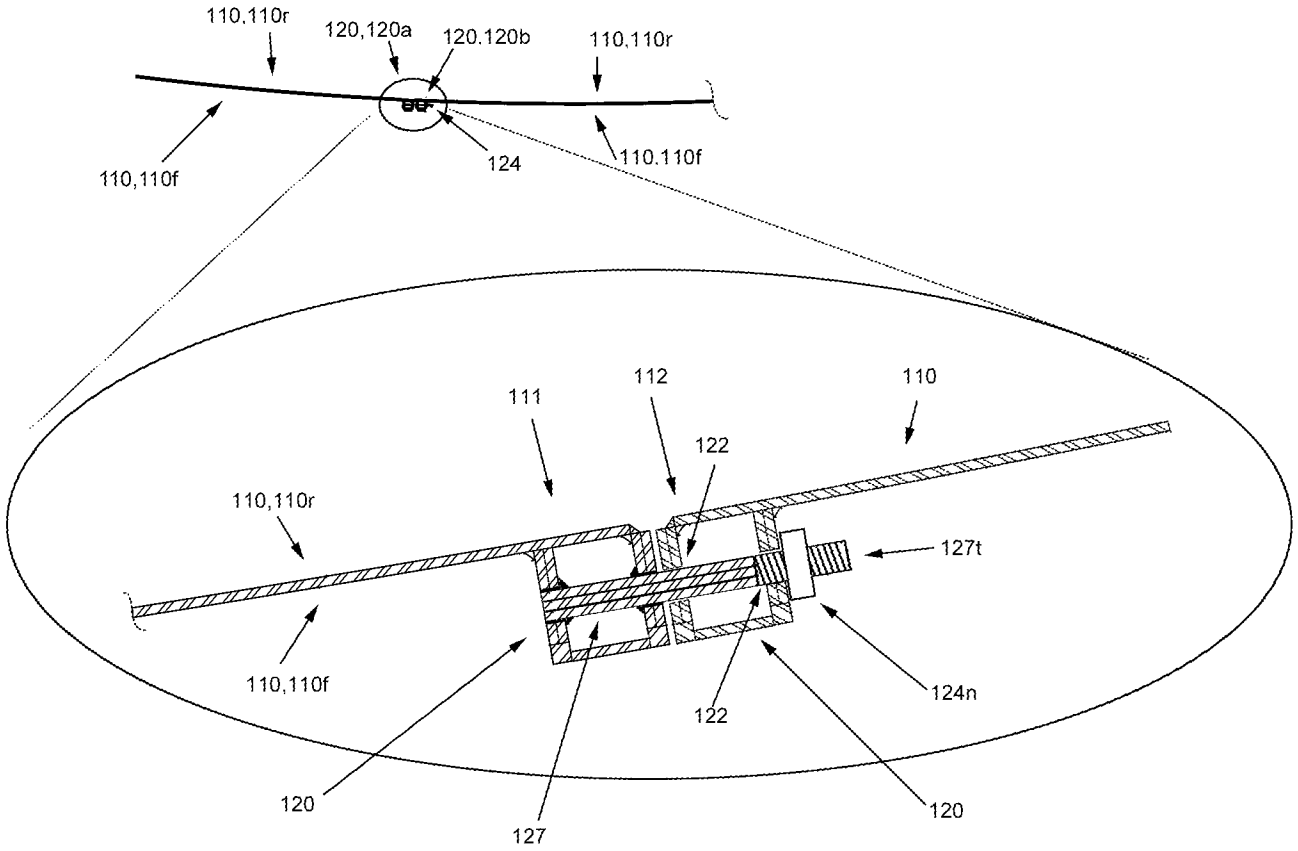
FIG. 11 is a top view of yet another embodiment of a fastening member and showing an enlarged section thereof.

In another embodiment of panels 110 (see FIG. 11), fastening members 120 on one end (e.g. 111) may further comprise a male member 127 projecting therefrom and suitably aligned with the fastener openings 122 of the fastening member 120 of another panel's adjacent end 112, said second fastening member 120 being suitable dimensions to allow a fastener 124 to engage said male member 127 or to allow said male member 127 to pass therethrough (see FIG. 11). Preferably, male member 127 has a threaded end 127*t* and fastener 124*n* is a nut that can threadably connect over said male member 127 at said end 112.

Preferably, the system 100 further comprises a carrying frame 130 of suitable dimensions to house a plurality of panels 110 in a generally upright and stacked or nested manner, as more clear shown in FIG. 6*a*. Advantageously, carrying frame 130 assists with transport of individual panels 110 (which can be carried in such upright position during transport). More advantageously, by keeping the panels 110 to 8 feet in height, the carrying frame 130 with a plurality of panels 110 inside can be easily transported without worry of violating general highway restrictions on load height.

Even more advantageously, less time will be required to manipulate individual panels 110 between a horizontal (transportation) position and a vertical upright (operating) position, because the panels 110 in the system 100 will remain in a generally upright configuration during both transportation (e.g. inside carrying frame 130) and operation.

Figure 6C:
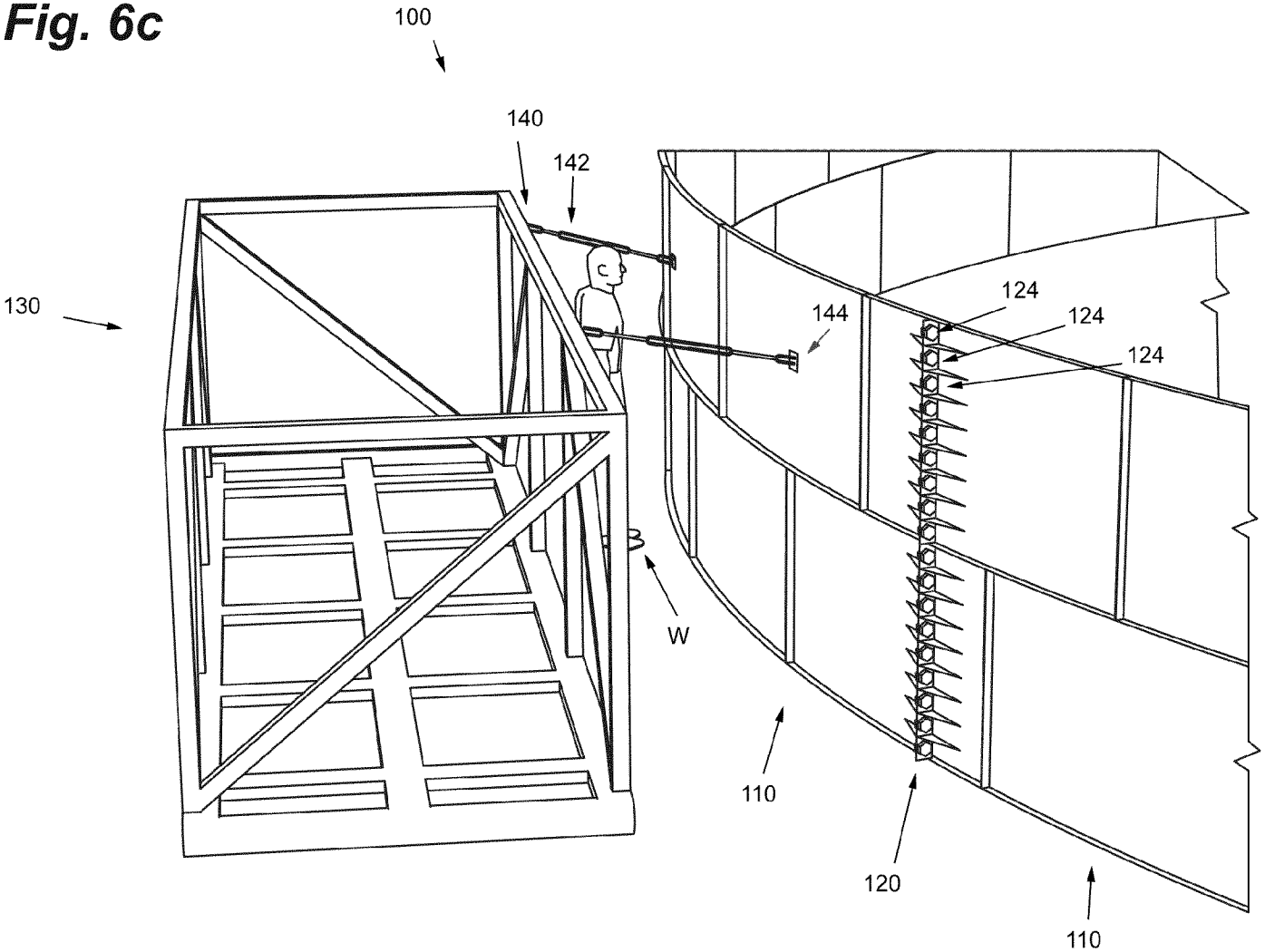
Figure 7A:
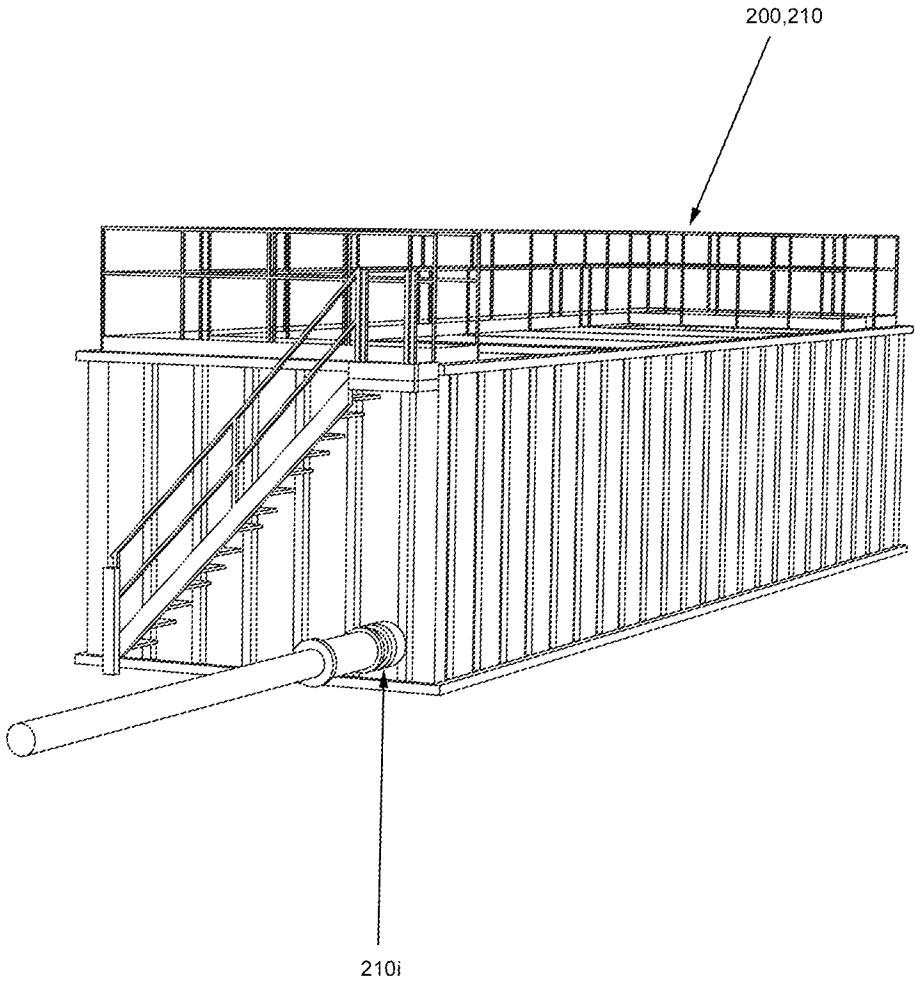
FIGS. 7*a*-7*d* are various views of yet another embodiment of a fluid handling and containment system and apparatus.
Figure 7B:
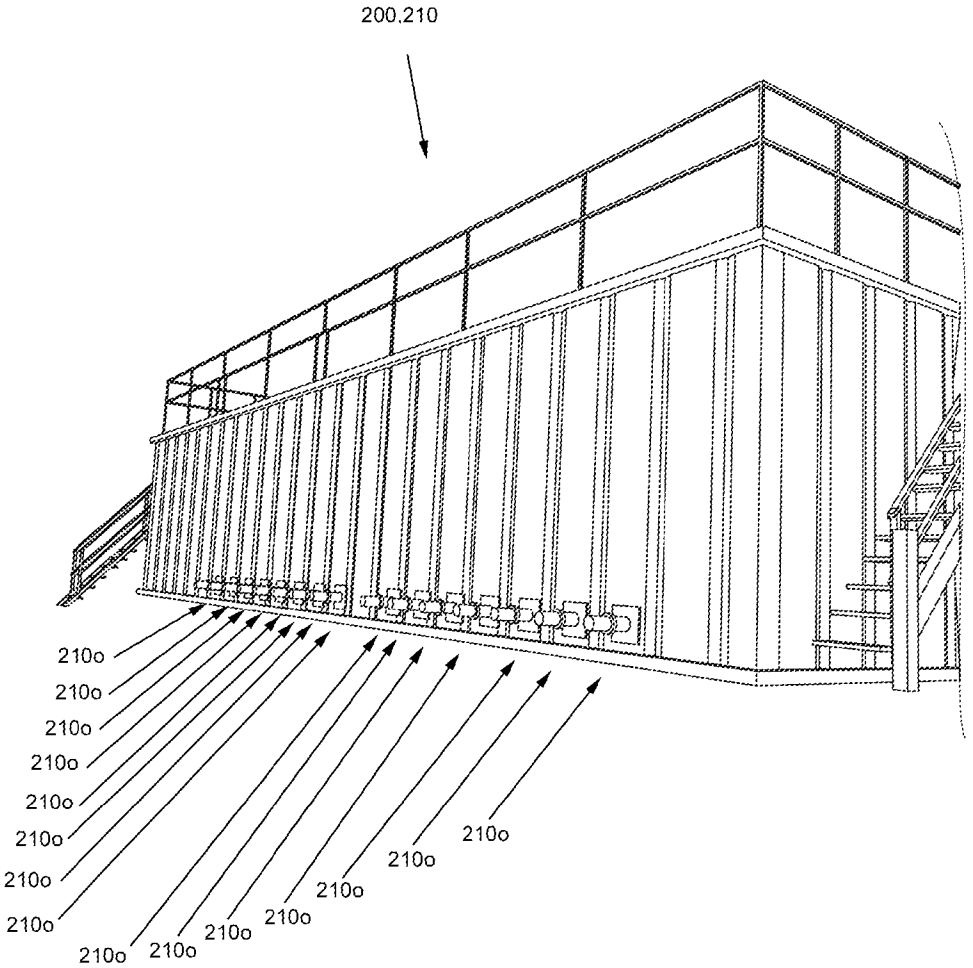
Figure 7C:
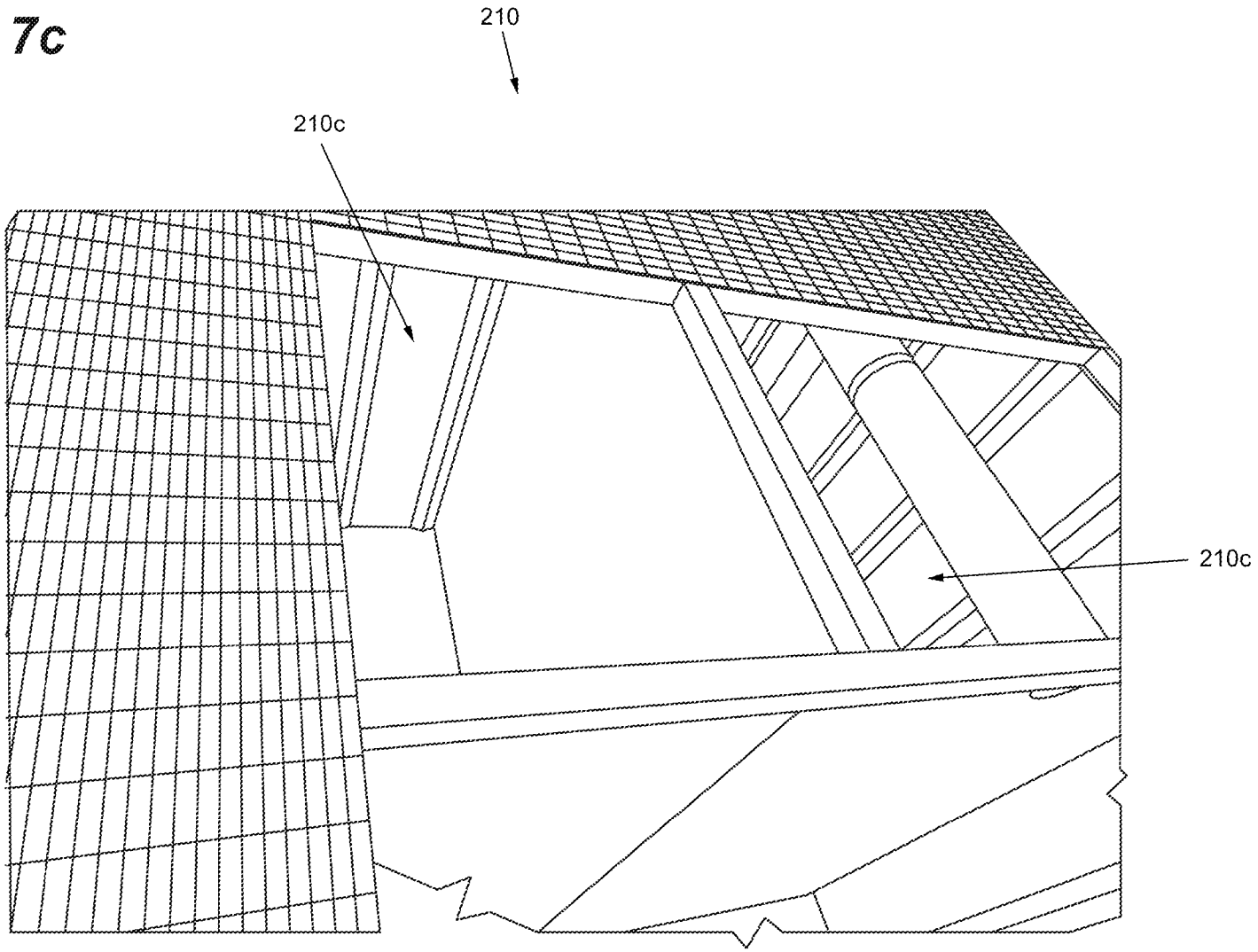
Figure 7D:
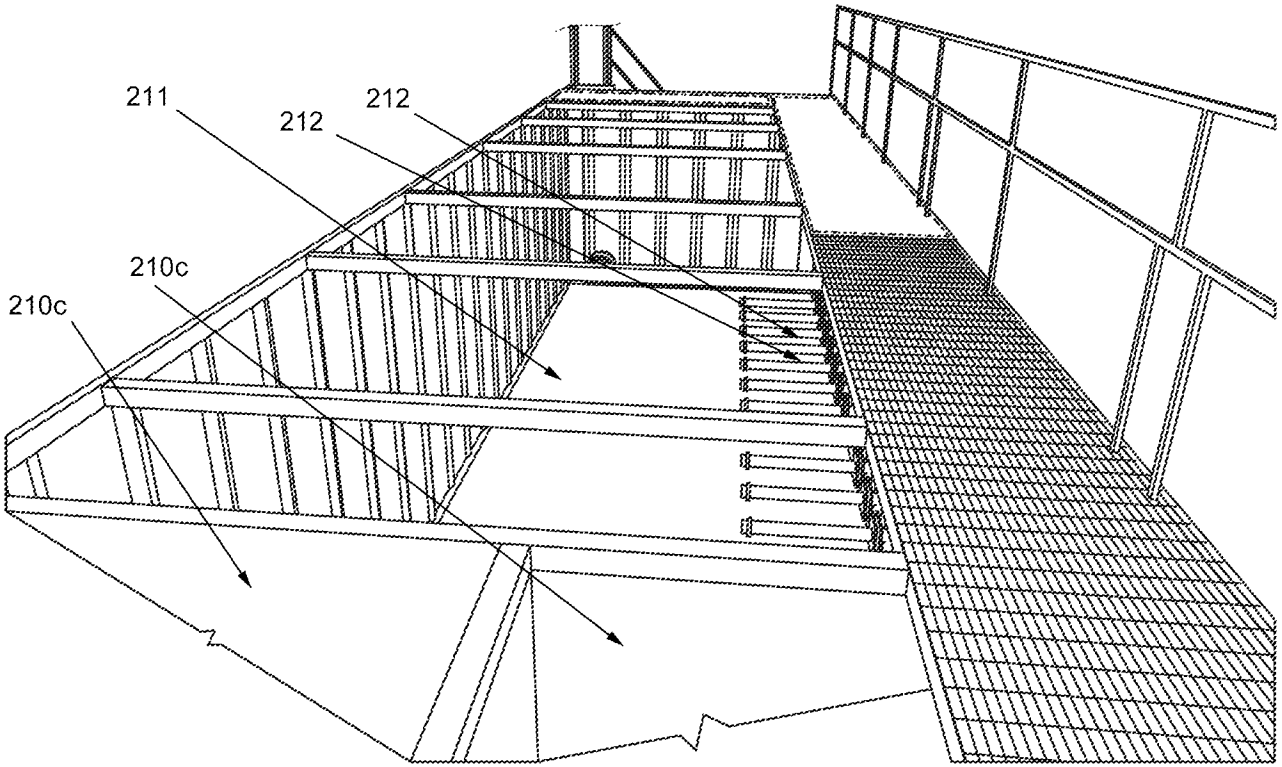
Figure 8A:
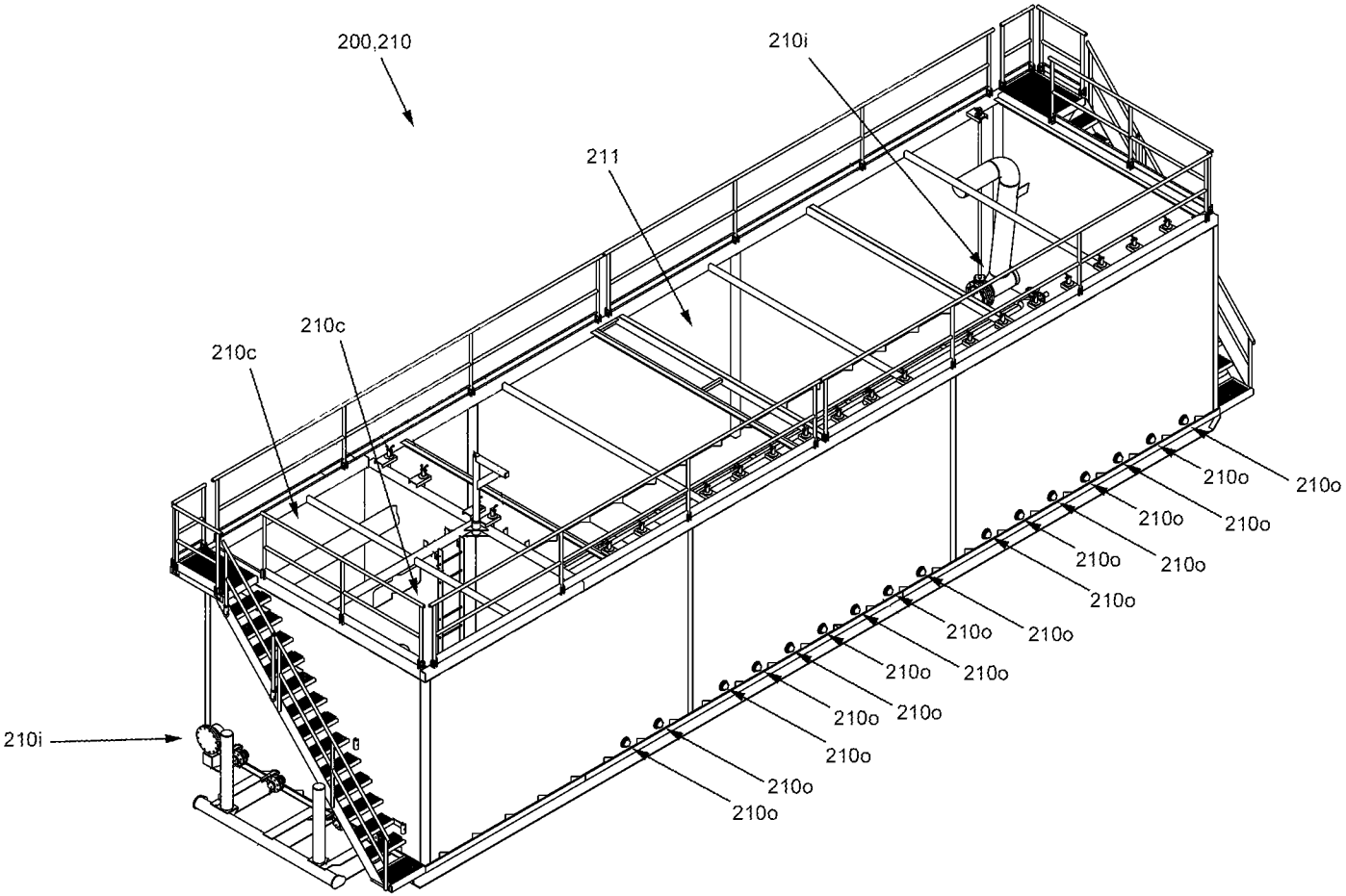
FIGS. 8*a*-8*e* are various views of yet another embodiment of a fluid handling and containment system and apparatus, similar to the embodiment of FIGS. 7*a*-7*d;*
Figure 8B:
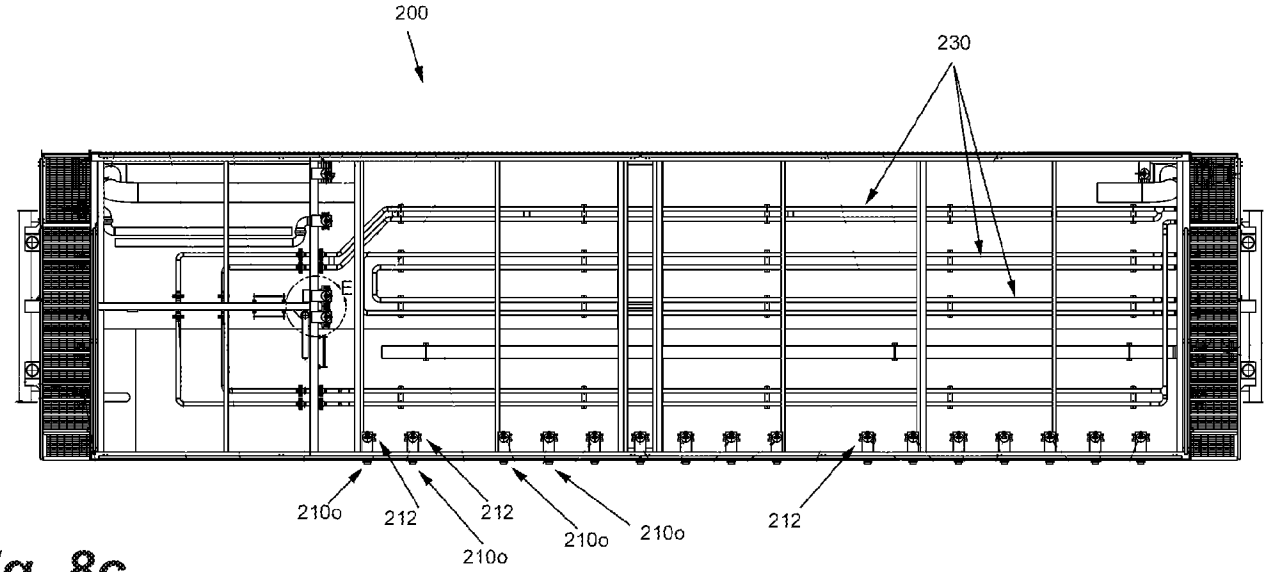
Figure 8C:
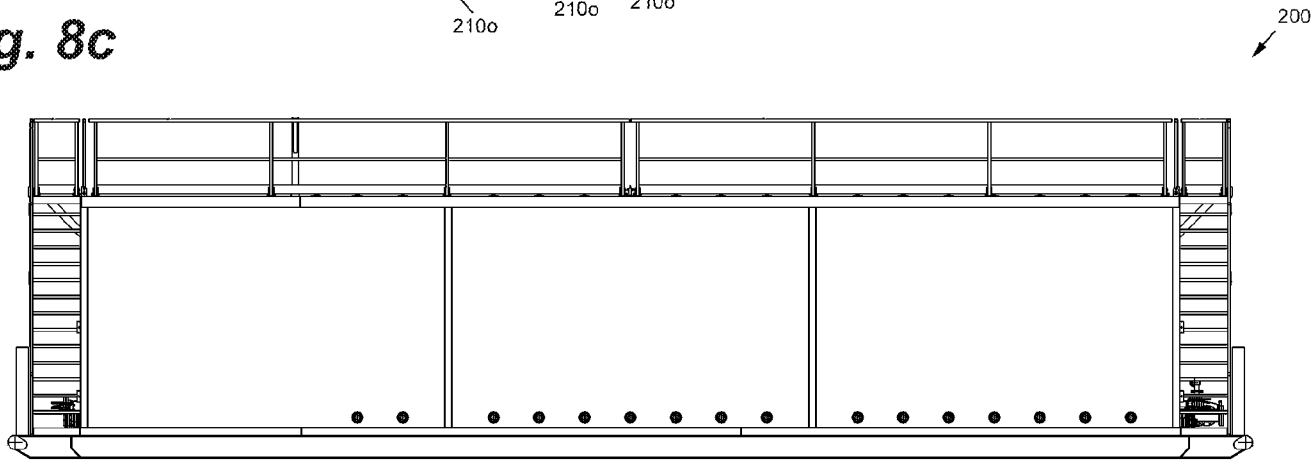
Figure 8D:
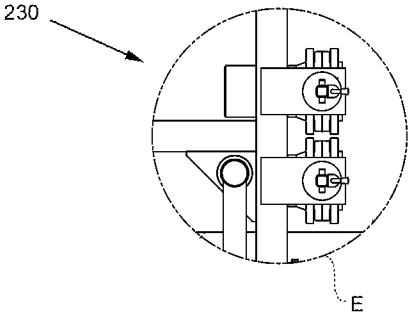
Figure 8E:
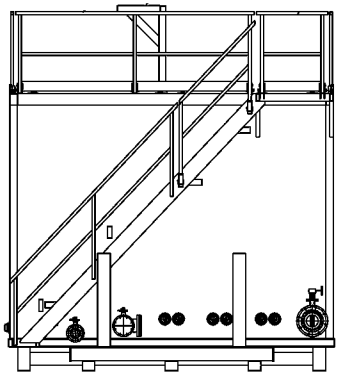
Figure 9B:
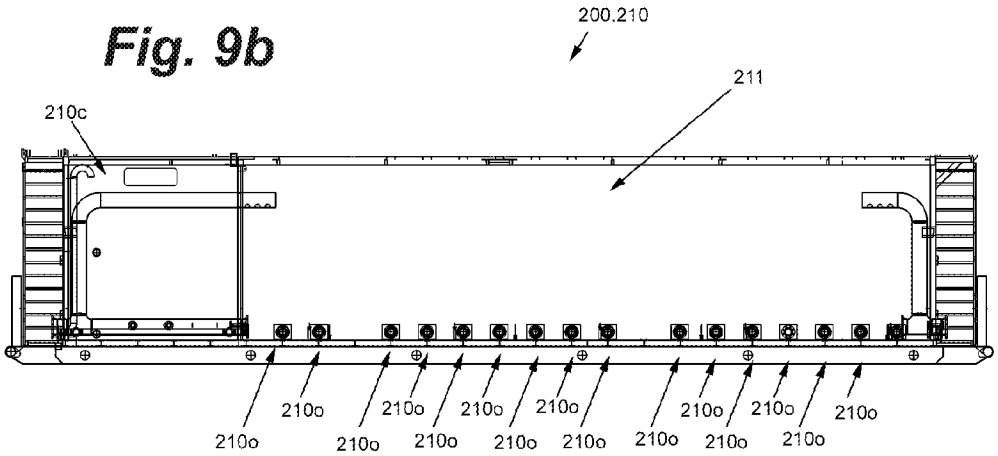
FIGS. 9*a*-9*c* are various views of yet another embodiment of a fluid handling and containment system and apparatus, similar to the embodiments of FIGS. 7*a*-7*d* and 8*a*-8*e;*
Figure 9A:
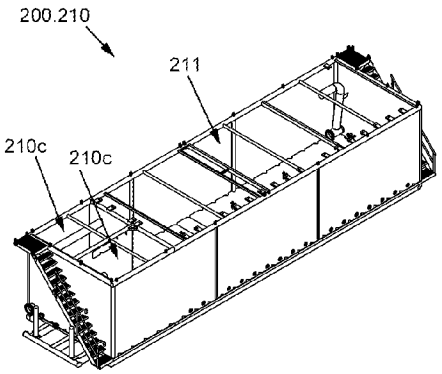
Figure 9C:
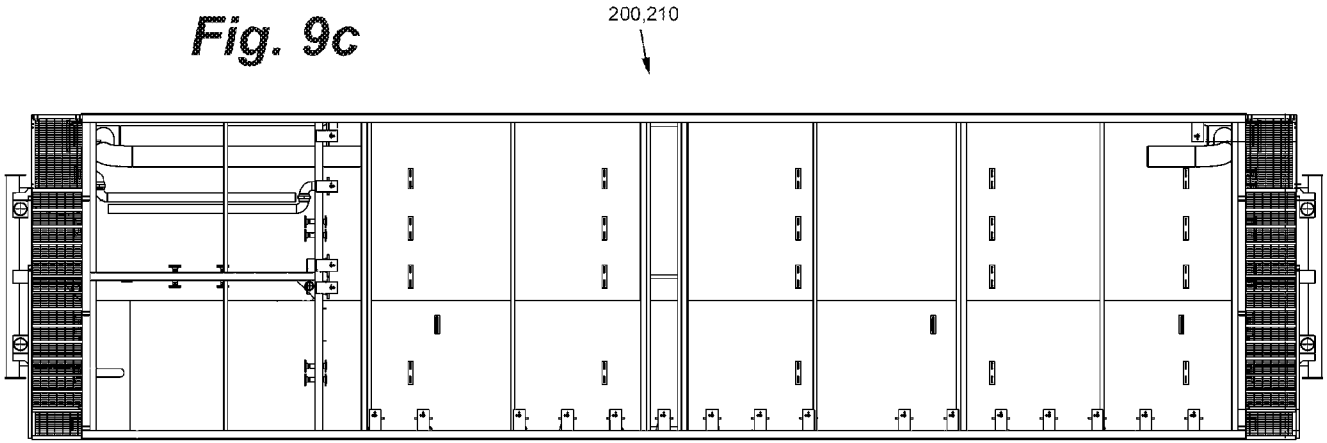
Figure 10:
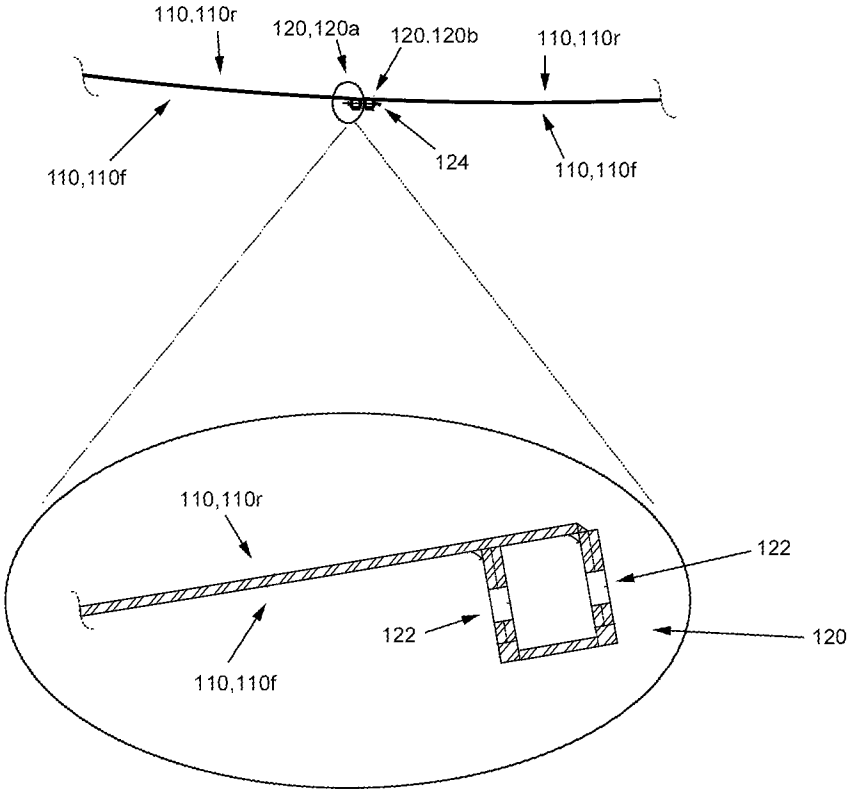
FIG. 10 is a top view of another embodiment of a fastening member and showing an enlarged section thereof.

More preferably, carrying frame 130 is provided with anchor points 140 and anchor members 142 to hold one or more panels 110 in a generally upright position (at anchor points 144) as more clearly shown in FIGS. 6*b* and 6*c*. Advantageously, carrying frame 130, anchor points 140 and anchor members 142 assist with the assembly and disassembly of the panels 110, especially when only a few panels 110 are placed upright and the entire ring of panels is not yet completed. More advantageously, the system and apparatus 100 can be easily set up and disassembled with using only a zoom boom Z and labourer or workman W with basic hand tools.

Referring now to the FIGS. 7*a*-9*c*, various embodiments of a fluid handling and containment system and apparatus 200 are illustrated. This system and apparatus 200 comprises a single tank 210 having a main compartment 211 to hold a quantity of fluid, said main compartment 211 having plurality of outlets 210*o*, the outlets 210*o* preferably located or positioned substantially in a row, substantially along the bottom of one side wall of the tank 210 (see FIG. 8*a*). Advantageously, such arrangement of the plurality of outlets allows for ease of connection of hoses and/or pipes (not shown), so as to subsequently direct fluid therethrough to a wellhead for fracturing operations.

The tank may be top filled or further comprise an inlet 210*i*. Preferably, the tank 210, and its main compartment 211, has a capacity of at least one traditional 400 bbl tank (i.e. at least 63 $m^3$) and the outlets 210*o* are at least 4" diameter outlets to allow for fluid to the tank 210 exit at a rapid rate. More preferably there are at least 12 outlets 210*o*, so that fluid can be withdrawn from the tank 210 at an equivalent rate to that required for hydraulic fracturing operations. Even more preferably the inlet, if present, has at least a 10" diameter. Yet even more preferably, the tank 210 has a plurality of compartments 210*c* to allow separation of undesirables from the fluid prior to entry into the main compartment 211, such as a compartment to settle solids from the fluid and/or a compartment to skim light fluids (e.g. oils) from the fluid (e.g. water). With such compartments, the tank 210 may then also be used during flow back operations, when fluid returns from the wellbore after fracturing operations. Such fluid can then be directed into the tank 210, i.e. through compartments 210*c*, whereby it is treated to remove oils and/or settle solids and then such treated fluid can be reused for subsequent fracturing operations or directed back to a fluid handling and containment system 100 as shown in FIGS. 2-6*c*, 10 and 11.

Preferably, the tank 210 is made from steel and is of such dimensions so as to be as large as possible to be transported on the highway without the requirement of special permits. In a preferred embodiment, the tank 210 is dimensioned as: 14' width×12' height×55' length with a resulting capacity of 200 $m^3$ of fluid and having 16 outlets so that fluid can be withdrawn at an equivalent, or even greater, rate to that required for hydraulic fracturing operations (preferably at a rate of 3 $m^3$ to 16 $m^3$ per minute). As such, a single tank 210 can hold (or buffer) a volume of approximately three traditional 400 bbl tanks (each typically having a capacity of 63 $m^3$).

More preferably, the outlets are each controlled via a valve 212. Even more preferably, the valve 212 is placed within or inside the tank 210 (so as to reduce likelihood of freezing when operating during colder temperatures) and is remotely actuated via a mechanical linkage that places operational control of the valve 212 outside the tanks 210 main interior volume (such as near to top edge of the tank). Yet even more preferably, the tank 210 further comprises an internal heat coil system 230 for fluid heating.

Advantageously, having a single tank 210 with a plurality of outlets 210*o* avoids the need for a hose and manifold system as required in conventional systems to tie various the 400 bbl tanks together, while still being able to allow fluid withdrawal at an equivalent (or greater) rate to that required for hydraulic fracturing operations. More advantageously, the 200 $m^3$ capacity reduces heat loss usually incurred due to higher surface-area-to-volume ratio as compared to multiple 400 bbl tanks. Even more advantageously, having the valves 212 placed within the tank's 210 interior, reduces likelihood of winter freezing of such valves. Yet even more advantageously, having an internal heat coil system 230, even further reduces fluid and/or valve freezing during winter operations. Still even more advantageously, the use of a single tank 210 reduces transportation and set-up costs and time associated with the use of traditional 400 bbl tank farm.

Preferably, one of the embodiments of the fluid handling and containment system 100 of FIGS. 2-6*c*, 10 and 11 can be use along with one of the embodiments of the fluid handling and containment system 200 of FIGS. 7*a*-9*w*—such as with fluid flowing from the containment system 100 to the tank 210 and then to the wellhead for fracturing operations. Advantageously, the use of a tank 210 along with a containment ring 100, allow for fluctuations in transfer pump rates (that may otherwise exist if going directly from system 100 to wellhead) that may arise during operations, as well as provide a sufficient volume of accessible fluid in the event that problems occur with transfer/pumping equipment from the main containment ring 100 to wellhead.

More advantageously, a 200 $m^3$ capacity tank 210 provides an operator several minutes to fix any problems encountered during fracturing operations, before having to making a final decision to stop fracturing operations. In this manner, tank 210 is used as "buffer tank" between main fluid containment (in system 100) and wellhead, but without the disadvantages associated with the tradition use of a number of 400 bbl tanks and the associated manifold(s) and hosing.

Those of ordinary skill in the art will appreciate that various modifications to the invention as described herein will be possible without falling outside the scope of the invention. In the claims, the word "comprising" is used in its inclusive sense and does not exclude other elements being present. The indefinite article "a" before a claim feature does not exclude more than one of the features being present.

The embodiments of the invention in which an exclusive property or privilege is being claimed are defined as follows:

1. A fluid containment system comprising:

a plurality of curved panels having a front face a rear face, a top end, a bottom end and two side ends;

wherein said plurality of curved panels are positioned serially adjacent one another in a generally upright or vertical manner, on their bottom ends, so as to comprise a generally circular arrangement;

each of said plurality of curved panels further comprising at least one fastening member on its front face;

wherein said fastening member is suitable to generally abut to a similar fastening member of an adjacent curved panel;

wherein when said plurality of curved panels are fastened to each other, the system is suitable to be lined with a liner and used for fluid storage wherein each of said plurality of curved panel members comprises two fastening members, said fastening members positioned one at each of a curved panel's side ends wherein each fastening member is a substantially square tubular member;

wherein the square tubular member has a longitudinal plane and said longitudinal plane is oriented substantially perpendicular to the longitudinal plane of the curved panel.

2. The fluid containment system of claim 1, wherein each fastening member is provided with at least one fastener opening of sufficient dimensions to allow passage of a fastener therethrough.

3. The fluid containment system of claim 2, wherein the fastener openings are positioned within each fastening member so as to substantially align with a fastener opening of an adjacent fastening member, when adjacent curved panels are aligned into the generally circular arrangement.

4. The fluid containment system of claim 1, further comprising a plurality of gussets to further secure the fastening members to the front face of their respective curved panel.

5. The fluid containment system of claim 1, dimensioned to hold at least 3000 m3 of fluid.

6. A fluid containment system comprising:

a plurality of curved panels having a front face a rear face, a top end, a bottom end and two side ends;

wherein said plurality of curved panels are positioned serially adjacent one another in a generally upright or vertical manner, on their bottom ends, so as to comprise a generally circular arrangement;

each of said plurality of curved panels further comprising at least one fastening member on its front face;

wherein said fastening member is suitable to generally abut to a similar fastening member of an adjacent curved panel;

wherein when said plurality of curved panels are fastened to each other, the system is suitable to be lined with a liner and used for fluid storage;

further comprising a carrying frame of suitable dimensions to house a plurality of curved panels in a generally upright and nested manner during transport of said curved panels;

wherein the carrying frame further comprises at least one anchor point, wherein at least one of said plurality of curved panels comprises at least one anchor point, and further comprising at least one anchor member positionable between an anchor point on said carrying frame and an anchor point on said curved panel.

7. The fluid containment system of claim 6, dimensioned to hold at least 3000 $m^3$ of fluid.

8. The fluid containment system of claim 6 wherein each fastening member is a fastening flange.

9. The fluid containment system of claim 8, wherein the fastening flange has a longitudinal plane and said longitudinal plane is oriented substantially perpendicular to the longitudinal plane of the curved panel.

10. The fluid containment system of claim 6, wherein each fastening member is provide with at least one fastener opening of sufficient dimensions to allow passage of a fastener therethrough.

11. The fluid containment system of claim 10, wherein the fastener openings are positioned within each fastening member so as to substantially align with a fastener opening of an adjacent fastening member, when adjacent curved panels are aligned into the generally circular arrangement.

12. The fluid containment system of claim 6, further comprising a plurality of gussets to further secure the fastening members to the front face of their respective curved panel.

* * * * *